US005517086A

United States Patent [19]

El-Hamamsy et al.

[11] Patent Number: 5,517,086

[45] Date of Patent: May 14, 1996

[54] MODIFIED VALLEY FILL HIGH POWER FACTOR CORRECTION BALLAST

[75] Inventors: Sayed-Amr El-Hamamsy; Mustansir H. Kheraluwala, both of Schenectady, N.Y.

[73] Assignee: General Electric Company, Schenectady, N.Y.

[21] Appl. No.: 403,087

[22] Filed: Mar. 13, 1995

[51] Int. Cl.[6] ..... H05B 41/16

[52] U.S. Cl. ..... 315/247; 315/272; 315/271; 363/37; 363/132

[58] Field of Search ..... 315/247, 209 R, 315/272, 275, 276, 278, 224; 363/37, 89, 98, 132

[56] References Cited

U.S. PATENT DOCUMENTS

| | | | |
|---|---|---|---|
| 4,862,040 | 8/1989 | Nilssen | 315/244 |
| 4,902,942 | 2/1990 | El-Hamamsy | 315/276 |
| 4,933,605 | 6/1990 | Quazi et al. | 315/224 |
| 5,012,161 | 4/1991 | Borowiec et al. | 315/247 |
| 5,387,847 | 2/1995 | Wood | 315/209 R |
| 5,408,403 | 4/1995 | Nerone et al. | 315/247 X |

OTHER PUBLICATIONS

"Characteristics of Load Resonant Converters Operated in a High–Power Factor Mode", M J Schutten, R L Steigerwald, M H Kheraluwala, IEEE Transactions on Power Electronics, vol. 7, No. 2, Apr., 1992, pp. 304–314.

*Primary Examiner*—Robert J. Pascal
*Assistant Examiner*—Haissa Philogene
*Attorney, Agent, or Firm*—Jill M. Breedlove; Marvin Snyder

[57] ABSTRACT

A modified valley fill circuit, including a main ballasting inductor for supplying an electrolytic capacitor, has an additional charging winding on the main ballasting inductor for charging the electrolytic capacitor to a predetermined voltage which maximizes the power factor of the input current by optimizing the conduction angle of the input current. In a discharge lamp ballast, the modified valley fill circuit reduces the lamp current crest factor by controlling the frequency with a lamp current control loop.

6 Claims, 3 Drawing Sheets

TIME SCALE : 2 ms/div

MODIFIED VALLEY FILL HIGH POWER FACTOR CORRECTION BALLAST

FIELD OF THE INVENTION

The present invention relates generally to power factor correction circuits and, more particularly, to a modified valley fill circuit useful for providing a high power factor in a discharge lamp ballast.

BACKGROUND OF THE INVENTION

Fluorescent lamp ballasts have been typically designed in the U.S. with input current power factor greater than 0.9. (Power factor is defined as the ratio of real power delivered to a circuit to the product of the rms current and voltage at its input.) The recent trend is to exceed power factors of 0.9 and even 0.95. Unfortunately, the requirement for simple, low-cost power factor correction circuits generally conflicts with the requirement for a lamp current crest factor of less than 1.7. (Lamp current crest factor is the ratio of peak lamp current to its rms current.) In addition, the efficacy of a fluorescent lamp decreases as lamp current increases. And, if a modulated current is supplied to a lamp, overall efficacy is lower than if just the average value of the current is supplied in an unmodulated fashion.

An integrated boost circuit that meets the power factor and lamp current crest factor requirements described hereinabove is presented in U.S. Pat. No. 5,408,403 of L. R. Nerone and D. J. Kachmarik, filed Aug. 25, 1992 and assigned to the instant assignee. The integrated boost circuit is used for powering a load with bi-directional current and comprises a full-wave rectifier, a series half-bridge converter, and a boost converter. The series half-bridge converter includes a first switch interposed between the bus conductor and a bridge-switch end of the load circuit; a second switch interposed between a ground conductor and the bridge-switch end of the load circuit; and a switching control circuit for alternately switching on the first and second switches. The boost converter comprises a boost capacitor connected between the bus and ground conductors, the level of charge on the boost capacitor determining the bus voltage on the bus conductor; a boost inductor connected by a one-way valve to the boost capacitor for discharging its energy into the boost capacitor; and a low-impedance path for periodically connecting a load end of the boost inductor to the ground conductor, thereby charging the boost inductor.

Unfortunately, circuits such as the integrated boost circuit are impractical for low-cost applications such as compact fluorescent lamps with integral ballasts.

Alternatively, simple circuits, such as, for example, a family of circuits known as valley fill circuits can be used for fluorescent lamp ballasts, but at the expense of low input current power factor or high lamp current crest factor. In a valley fill circuit, an electrolytic capacitor is charged to half the peak line voltage. The electrolytic capacitor is connected to the ballast dc bus via a diode. As long as the line voltage remains above the capacitor voltage, the line supplies the ballast. When the line voltage goes below the capacitor voltage, the diode conducts, thereby feeding the ballast with current and reverse-biasing the rectifier bridge diodes. Thus the voltage supplied to the ballast follows the line voltage from an angle of 60° to an angle of 120° and follows the capacitor voltage near the zero-crossings of the line(referred to as "valleys").

In a typical valley fill circuit, the conduction angle of the line current allows the circuit to have a power factor that is just slightly above 0.9. At the same time, the modulated bus voltage results in a lamp current crest factor that is just slightly below 1.7. The margins by which the circuit meets the power factor and lamp current requirements are very narrow, such that the normal spread of component values in production could cause a substantial fraction of the ballasts to fail to meet them. Therefore, a simple, low-cost, high-performance high power factor correction circuit is still needed.

SUMMARY OF THE INVENTION

A modified valley fill circuit, including a main ballasting inductor for supplying an electrolytic capacitor, comprises an additional charging winding on the main ballasting inductor for charging the electrolytic capacitor to a predetermined voltage which maximizes the power factor of the input current by optimizing the conduction angle of the input current. In a discharge lamp ballast, this valley fill circuit reduces the lamp current crest factor by controlling the frequency with a lamp current control loop. As a result, a power factor of approximately 0.95 and a lamp current crest factor of approximately 1.7 can be achieved in a simple and economical circuit.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

The modified valley fill high power factor circuit of the present invention is described herein with reference to a discharge lamp ballast, in particular, a compact fluorescent discharge lamp ballast. However, the principles of the present invention are not limited to discharge lamp ballasts, but can be used in other applications, such as, for example, an off-line dc power supply.

Figure 1:
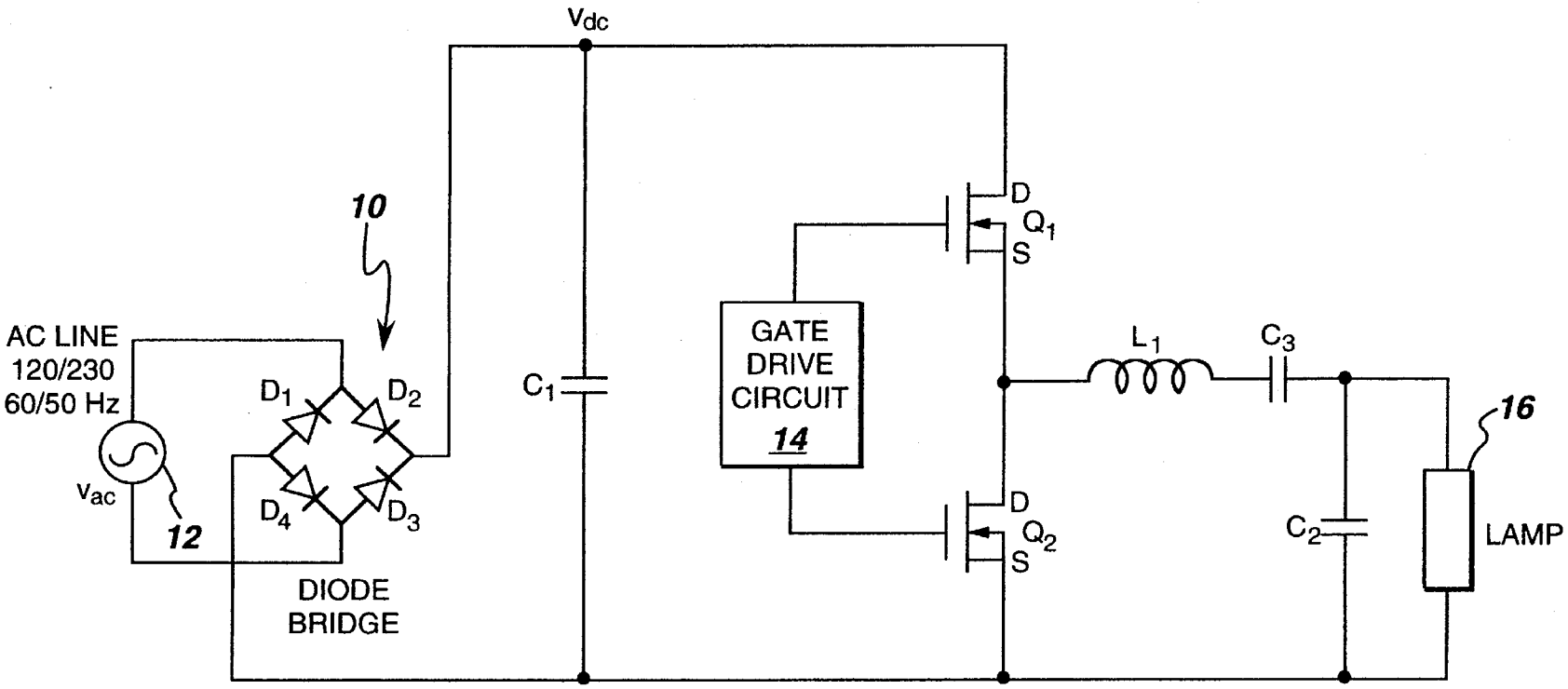
fig. 1 PRIOR ART
FIG. 1 schematically illustrates a conventional ballast for a fluorescent discharge lamp.

FIG. 1 illustrates a conventional half-bridge ballast configuration for a fluorescent lamp. The ballast of FIG. 1 includes a full-wave rectifier 10, shown as comprising diodes $D_1$–$D_4$, for rectifying an ac voltage $V_{ac}$ supplied from a source 12. A capacitor $C_1$, typically electrolytic, is coupled across the rectifier output, thereby providing a rectified, filtered voltage $V_{dc}$ to a half-bridge connection of switching devices $Q_1$ and $Q_2$. A gate drive circuit 14 is provided for alternately switching devices $Q_1$ and $Q_2$ to provide bi-directional current flow through a resonant load circuit, including a series connection of a resonant inductor $L_1$, a resonant capacitor $C_2$, and a dc blocking capacitor $C_3$. A load 16, illustrated as a fluorescent discharge lamp, is connected in parallel with resonant capacitor $C_2$.

Disadvantageously, the circuit of FIG. 1 introduces a relatively high proportion of input frequency harmonics into the input current, resulting in a low power factor.

Figure 2:
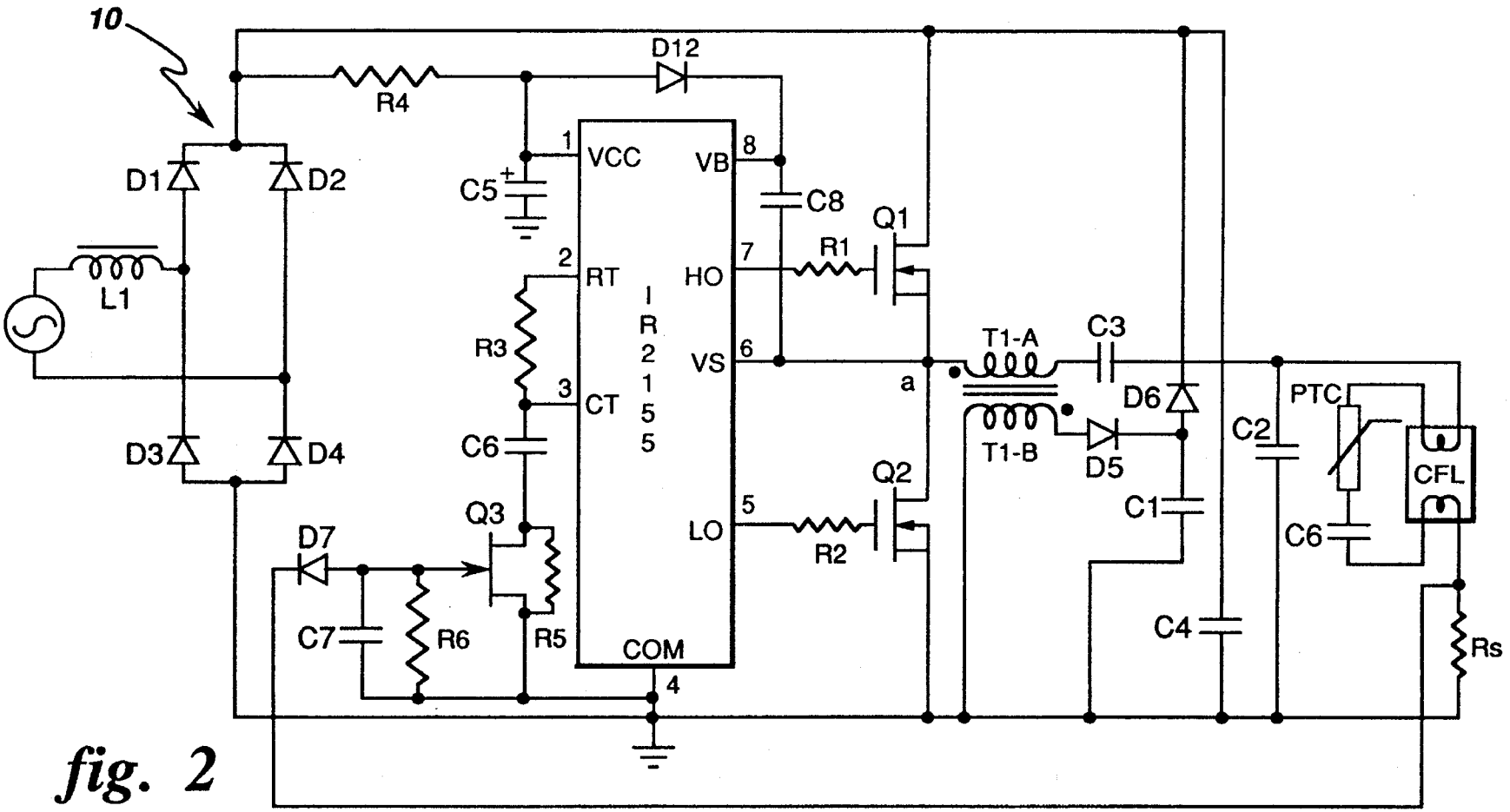
FIG. 2 schematically illustrates a high power factor modified valley fill ballast for a fluorescent lamp in accordance with the present invention.

In accordance with the present invention, FIG. 2 illustrates a high power factor circuit comprising a modified valley fill circuit suitable for use in a discharge lamp ballast, e.g., a compact fluorescent discharge lamp (CFL) ballast. The circuit of FIG. 2 comprises front-end bridge rectifier 10 and energy storage capacitor C1, preferably electrolytic, which is prevented from charging directly from the line by diode D6. A high-frequency filter capacitor C4 is connected in paralled with the series combination of capacitor C1 and diode D6. The half-bridge switching inverter comprising MOSFET's Q1 and Q2, for example, is connected across the dc bus. The half-bridge inverter is illustrated, by way of example only, as being driven by a self-oscillating power MOSFET gate driver of a type IR2155 manufactured by International Rectifier Corporation. A high-frequency square wave generated at the half-bridge midpoint a is applied to a series resonant network comprising inductor T1-A and capacitor C2. The compact fluorescent lamp is connected across resonant capacitor C2. Resonant inductor T1-A functions as the main ballasting inductor. Capacitor C3 is a dc blocking capacitor.

In operation, the switching frequency of devices Q1 and Q2 is maintained above the resonant frequency so that MOSFET's Q1 and Q2 are switched in a substantially lossless manner for improved efficiency, lower voltage stresses and lower electromagnetic interference (EMI).

Advantageously, the modified valley fill circuit topology according to the present invention is simple, economical and can operate at a power factor (pf) of approximately 0.95 and a lamp current crest factor (ccf) of approximately 1.7. As with all valley fill circuits, the basic principle is to charge electrolytic capacitor C1 to a fraction of the peak line voltage. However, in accordance with the present invention, capacitor C1 is charged to a predetermined voltage which maximizes the power factor of the input current by optimizing the conduction angle of the input current. To this end, an additional charging winding on the high-frequency ballasting inductor is provided to peak-charge the valley fill capacitor C1. To maximize power factor, the optimal conduction angle of the input current is 135° (per line half cycle), as calculated in "Characteristics of Load Resonant Converters Operated in a High Power Factor Mode" by M. J. Schutten, R. L. Steigerwald, and M. H. Kheraluwala, *IEEE Transactions on Power Electronics*, April 1992, Vol. 7, No. 2, pp. 304–314, which results in a maximum power factor of 0.96. The turns ratio of the charging winding to main winding of the ballast inductor is selected such that the capacitor is peak-charged to a voltage given by the following expression:

$$VCl_{pk}=Vline_{pk}\cdot\sin(22.5°)=0.38\ Vline_{pk}.$$

Under these conditions, double line frequency modulation of the bus voltage is quite severe and an open loop circuit would not meet the lamp ccf requirement.

Hence, the ballast load network (comprising the lamp, parallel capacitor C2, and ballasting inductor T1-A) is chosen so that it operates in a mode wherein frequency control can be employed. The frequency of the ballast is controlled by a current feedback loop which minimizes modulation of the lamp current, ensuring that the lamp ccf requirement is met. And, since this is done with an active feedback loop, as shown, the lamp ccf will not be sensitive to line voltage variations or to lamp and component variations.

In operation, the storage capacitor C1 is peak-charged through an auxiliary winding T1-B wound on the resonant inductor T1-A. The turns ratio of the transformer T1 is optimized to maintain the voltage across C1 to a value that optimizes the conduction time of the bridge rectifier and hence maximizes the line power factor. Since the dc bus has a substantial double line frequency modulation, the switching frequency of the inverter must be modulated over the line half-cycle to maintain the lamp ccf within required limits.

The illustrated lamp current feedback scheme involves a current sensing resistor Rs for sensing lamp current. The rectified and filtered lamp current modulates the channel resistance of a JFET Q3 which, in turn, changes the frequency of the front-end oscillator output signal of the IR2155 gate driver in a manner such as described in commonly assigned, copending U.S. patent application Ser. No. (08/386,570) of S-A. El-Hamamsy and M. H. Kheraluwala. According to S-A. El-Hamamsy and M. H. Kheraluwala, a fixed duty ratio, variable frequency, square wave generator may comprise an astable multivibrator including a pair of resistors coupled in series between a supply voltage terminal and a capacitor, such as of a type implemented with a 555 timer, and further comprises an electrically controllable variable resistor, such as a JFET or a MOSFET, connected between the capacitor and ground. (The front-end of an IR2155 gate driver is a programmable oscillator similar to a 555 timer.) In a current-controlled version wherein the sensed current is ac, the anode of a diode is connected to the gate of the JFET, and the cathode of the diode is connected to a sensing resistor for sensing current in a load connected thereto. The multivibrator generates a ramp voltage across the capacitor which varies between predetermined fractions of the supply voltage with a fixed duty ratio. The JFET has a channel resistance which varies with input voltage thereto. The capacitor of the multivibrator charges and discharges through the series connection of the resistors and the JFET channel resistance with charging and discharging times that vary with the input voltage to the JFET.

Figure 3:
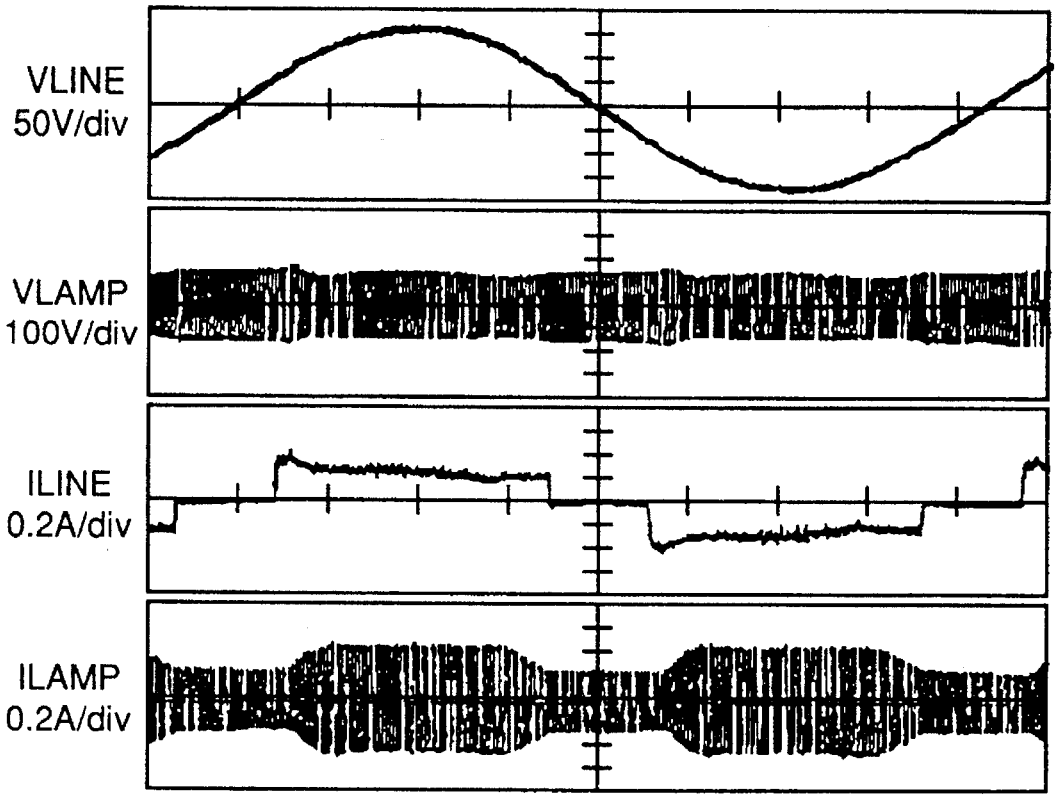
FIG. 3 graphically represents experimental waveforms for a 25 W, 120 V, 60 Hz ballast driving a compact fluorescent lamp in accordance with the present invention.

FIG. 3 shows the line voltage Vline, lamp voltage Vlamp, line current Iline, and lamp current Ilamp for a modified valley fill circuit according to the present invention designed to drive a 25 W compact fluorescent lamp from a 120 V, 60 Hz supply. The THD was optimized at 26% with a pf=0.96. The lamp ccf was measured in the range of 1.7–1.75. The overall efficiency was measured to be 89%.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A ballast for a discharge lamp, comprising:

a rectifier for receiving an ac line voltage and providing a rectified voltage on a dc voltage bus;

a half-bridge configuration of switching devices coupled across said dc voltage bus;

an energy-storage capacitance coupled to said dc bus by a diode;

a resonant output circuit comprising a ballast inductor connected to a junction between said switching devices of said half-bridge and a resonant capacitance, said lamp being connected in parallel with said resonant capacitance, said ballast inductor comprising an additional winding thereon for supplying said energy storage capacitance, said additional winding having a turns ratio with respect to turns of said inductor which is selected to maintain the voltage across said energy-storage capacitance at less than half the peak line voltage in order to optimize conduction time of said rectifier and thereby maximize input power factor; and a current feedback loop comprising frequency control for maintaining current through said lamp substantially constant.

2. The ballast of claim 1 wherein the voltage across said energy-storage capacitance is maintained at approximately 0.38 times the peak line voltage.

3. The ballast of claim 1 wherein said current feedback loop comprises a fixed duty ratio, variable frequency, square wave generator.

4. The ballast of claim 3 wherein said fixed duty ratio, variable frequency, square wave generator comprises a current-controlled square wave generator, said current-controlled square wave generator comprising a current sensor for sensing current through said lamp.

5. The ballast of claim 4 wherein said current sensor comprises a current sense resistor.

6. The ballast of claim 4 wherein said current sensor comprises a current transformer.

* * * * *